US006776115B1

(12) United States Patent
De Meo

(10) Patent No.: US 6,776,115 B1
(45) Date of Patent: Aug. 17, 2004

(54) SHAFT MOUNTED PERSONAL WIND POWER DEVICE

(76) Inventor: Albert De Meo, 47 Champney St., Groton, MA (US) 01450

( * ) Notice: Subject to any disclaimer, the term of this patent is extended or adjusted under 35 U.S.C. 154(b) by 0 days.

(21) Appl. No.: 10/387,970

(22) Filed: Mar. 13, 2003

(51) Int. Cl.[7] ..... B63H 9/04
(52) U.S. Cl. ..... 114/97; 114/102.18
(58) Field of Search ..... 114/102.1, 102.18, 114/39.16, 102.11, 98, 97, 99, 11.5, 89

(56) References Cited

U.S. PATENT DOCUMENTS

| | | | | |
|---|---|---|---|---|
| 3,924,870 A | * | 12/1975 | Spivack et al. | 280/810 |
| 4,311,324 A | | 1/1982 | Fries | 280/810 |
| 4,651,665 A | | 3/1987 | Drake | 114/39 |
| 4,674,428 A | * | 6/1987 | Weber et al. | 114/39.16 |
| 5,095,838 A | * | 3/1992 | Smith | 114/115 |

FOREIGN PATENT DOCUMENTS

GB 2079230 A * 1/1982

* cited by examiner

*Primary Examiner*—Stephen Avila
(74) *Attorney, Agent, or Firm*—Thomas P. Grudt

(57) ABSTRACT

A personal wind power device is disclosed that includes at least one sail frame assembly firmly, yet removably, coupled to a shaft. The sail frame assembly includes a base that is coupled to the shaft and that has first and second boom arms pivotally attached to it. A sail is affixed between the first and second boom arms and the boom arms may be in a first stored position, in which the sail is not deployed, or in a second deployed position, in which the sail is firmly held in a deployed position and is able to catch the wind. A latch that is normally closed is pivotally attached to the base and a locking mechanism coupled to the latch. When in the normally closed position, the latch urges the locking mechanism into a stopped orientation, in which movement of the boom arms and sail is prevented. When the latch is moved into the open position, the locking mechanism is released and the boom arms and the sail are able to move into the deployed position, or are able to be retracted into the closed position.

24 Claims, 5 Drawing Sheets

SHAFT MOUNTED PERSONAL WIND POWER DEVICE

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

This invention relates generally to vehicles that use the wind to provide locomotive power and in particular to portable wind catching devices to provide locomotive power for personally powered transportation vehicles such as a kayak, canoe, skis, ice skates, rollerblades and skateboards.

Wind power has been used for centuries to provide locomotive power for boats, ice skimmers, and land vehicles. Typically, these vehicles have been large, e.g., a sail boat, have a mast or boom rigidly affixed to the vehicle, and require additional hardware and ropes in order to properly hold and orient the sail to catch the wind. Sails have also been used on small personal powered vehicles such as a kayak, canoe, skis, rollerblades and skateboards to catch the wind to provide additional locomotive power. However, these personal powered vehicles typically do not come equipped with a permanently affixed mast or boom or the additional hardware and ropes that are necessary to effectively use a sail. These small personal powered vehicles typically have had additional mounting blocks permanently attached to it in order to mount a mast, boom, and any additional hardware needed to properly hold and orient the sail to catch the wind.

It would be advantageous therefore to provide a portable sail type device that did not have to be permanently mounted or affixed to the personal powered vehicle in order to catch the wind and provide additional locomotive power thereto.

BRIEF SUMMARY OF THE INVENTION

A personal wind power device is disclosed that includes at least one sail frame assembly firmly, yet removably, coupled to a shaft. The sail frame assembly includes a base that is coupled to the shaft and that has first and second boom arms pivotally attached to it. A sail is affixed between the first and second boom arms and the boom arms may be in a first stored position, in which the sail is not deployed, or in a second deployed position, in which the sail is firmly held in a deployed position and is able to catch the wind. A latch that is biased into a normally closed position by biasing element forms a locking mechanism. The latch is pivotally attached to the base and the biasing element is arranged between the base and a portion of the latch. When in the normally closed position, the latch urges the locking mechanism into a stopped orientation in which, in one embodiment, the locking mechanism compresses a cord attached to the boom arms and sail to prevent movement thereof. When the latch is moved into the open position, the locking mechanism releases the cord and the boom arms and the sail are able to move into the deployed position, or are able to be retracted into the closed position.

Other features, aspects and advantages of the above-described method and system will be apparent from the detailed description of the invention that follows.

BRIEF DESCRIPTION OF THE SEVERAL VIEWS OF THE DRAWING

The invention will be more fully understood by reference to the following detailed description of the invention in conjunction with the drawing of which.

DETAILED DESCRIPTION OF THE INVENTION

Figure 1A:
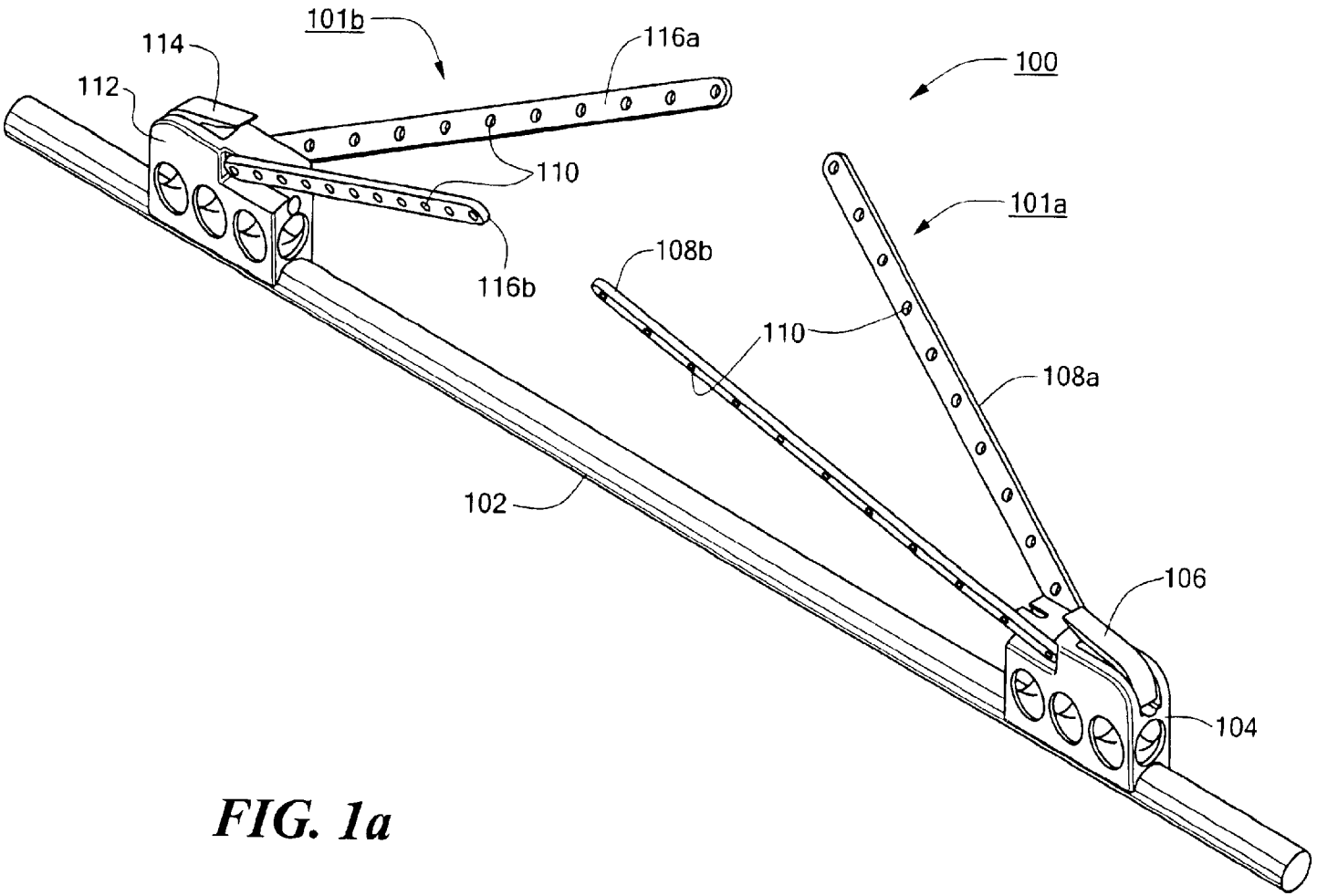
FIG. 1*a* is an isometric view of the shaft mounted personal wind power device according to the present invention.
Figure 1B:
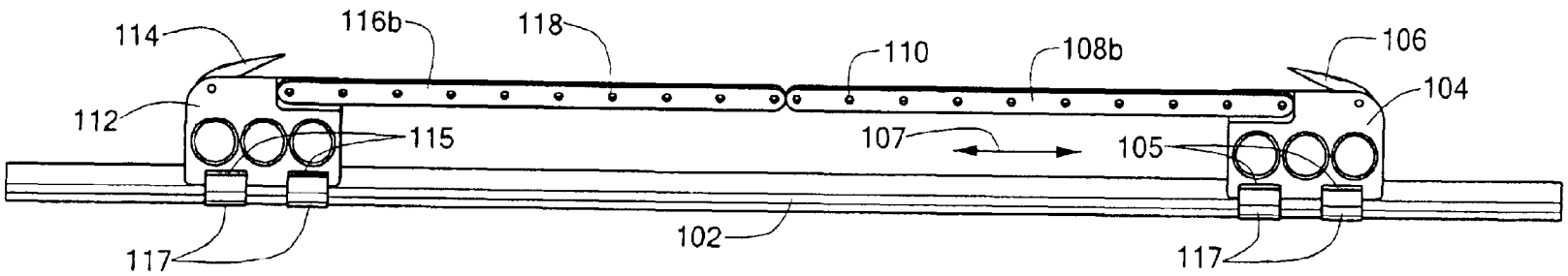
FIG. 1*b* is a side view of the shaft mounted personal wind power device of FIG . 1*a;*
Figure 1C:
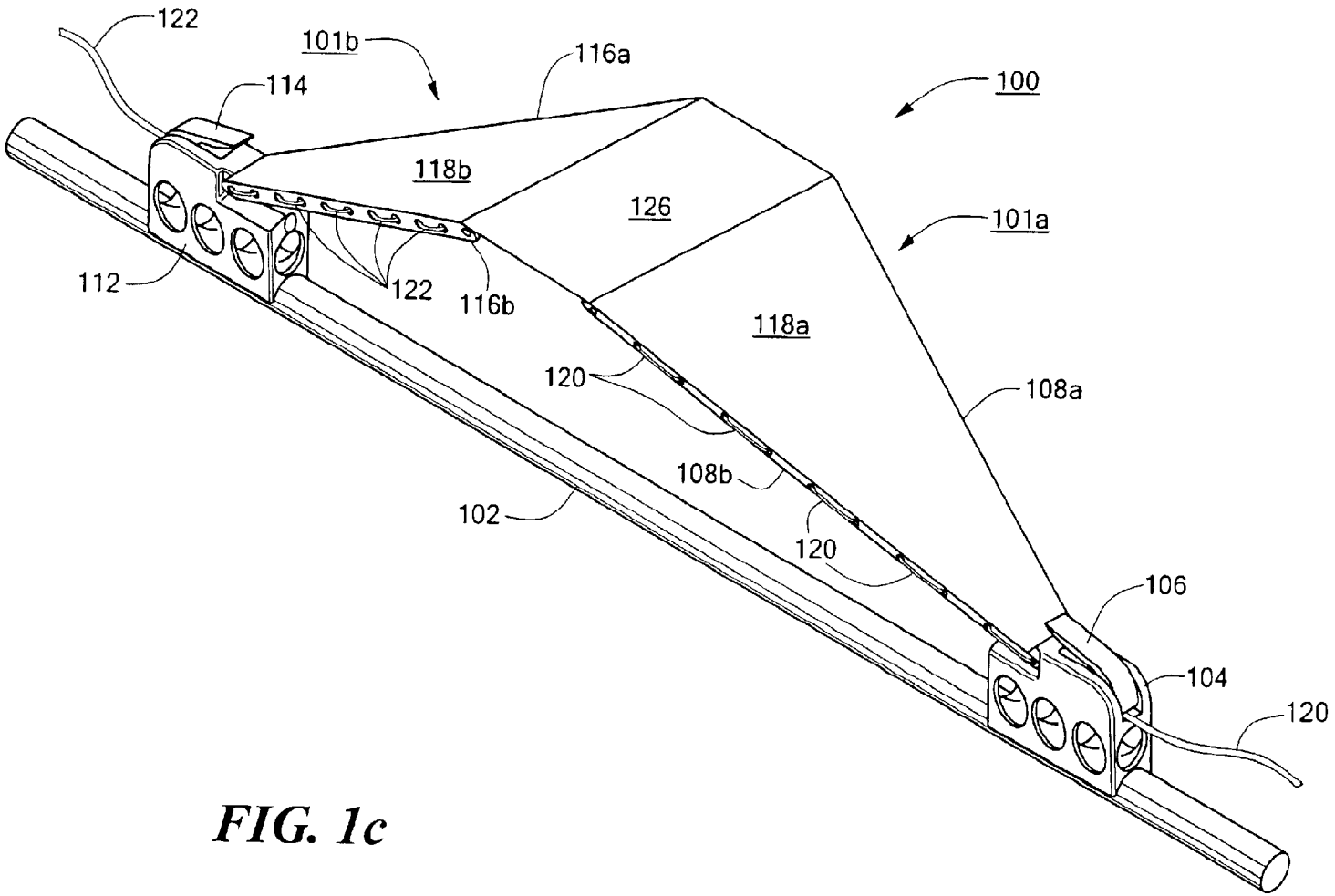
FIG. 1*c* is an isometric view of the shaft mounted personal wind power device of FIG. 1*a* that includes a sail.

FIGS. 1A, 1B, and 1C (collectively, FIG. 1) depict a shaft mounted personal wind power device 100 that includes a first sail frame assembly 101*a* and a second sail frame assembly 101*b.* The first and second sail frame assemblies 101*a* and 101*b* are affixable to a shaft 102, which may be without limitation for example, a kayak paddle, canoe paddle, or a simple shaft having sufficient length that for example can be used with a skateboard, ice skates, or rollerblades. The first sail frame assembly 101*a* includes a base 104 that is removably attached to shaft 102. In one embodiment, the base 104 includes slots 105 that receives strap fasteners 117. The strap fasteners are wrapped around the shaft 102 and can be secured using hook and loop fasteners, self-latching buckles, or other suitable fasteners. The base 104 includes a latching mechanism that includes a latch 106 that is pivotally attached to the base and, as explained in more detail below, is used to control the deployment and retraction of the first sail frame assembly 101*a* via cord 120.

The first sail frame assembly 101*a* further includes first and second boom arms 108*a* and 108*b,* respectively, that are pivotally attached to the base 104 and have a sail 118*a* secured therebetween via a plurality of holes 110 and the cord 120. The cord 120 is threaded through the plurality of holes 110 in the first and second boom arms 108*a,* 108*b,* and corresponding holes (not shown) in the first and second edges of the sail material 118*a.*

The boom arms 108*a* and 108*b* are sized and configured such that they may be repositioned from a first stored position, in which the sail 118*a* is folded between them and not deployed, to a second deployed position, in which the sail 118*a* is firmly held in a deployed position and able to catch air and provide locomotive power. The boom arms 108*a* and 108*b* are further able to be returned to the first stored position, thereby retracting the sail 118*a* into the stored position where it is unable to catch wind. In the first stored position, the boom arms 108*a* and 108*b* are stored oriented substantially parallel to one another and generally parallel to the longitudinal axis 107 of the base 104, in order to minimize the area needed to store the sail material and reduce the interference to the user. However, in the second deployed position, the two boom arms 108*a* and 108*b* generally diverge outward and upward from the base 104 forming a half-diamond shape and maximizing the area of sail 118*a* available to catch the wind.

Similarly, the second sail frame 101*b* includes a base 112 that is firmly yet removable attached to shaft 102. In one embodiment, the base 112 includes slots 115 that receive strap fasteners 117 that are wrapped around the shaft 102. The strap fasteners 117 can be secured using hook and loop fasteners or other suitable fasteners. The base 112 includes a latching mechanism that includes latch 114 that is pivotally attached to the base and, as explained in more detail below, is used to control the deployment and retraction of the second sail frame 101*b*. The second sail frame 101*b* further includes third and fourth boom arms 116*a* and 116*b*, respectively, that are pivotally attached to the base 112 and have a sail 118*b* secured therebetween via a plurality of holes 118 and a rope or cord 119. The cord 119 is threaded through the plurality of holes 118 in the third and fourth boom arms 116*a*, 116*b*, and corresponding holes (not shown) in the first and second edges of the sail material 118*b*.

The third and fourth boom arms 116*a* and 116*b* are sized and configured such that they may be repositioned from a first stored position, in which the sail 118*b* is not deployed, to a second deployed position, in which the sail 118*b* is firmly held in a deployed position and able to catch air and provide locomotive power. The third and fourth boom arms 116*a* and 116*b* are further able to be returned to the first stored position, thereby retracting the sail 118*b* into the stored position where it is unable to catch wind. In the first stored position, the third and fourth boom arms 116*a* and 116*b* are stored oriented substantially parallel to one another and generally parallel to the longitudinal axis 107 of the base 112, in order to minimize the area needed to store the sail material and reduce the interference to the user. However, in the second deployed position, the two boom arms 116*a* and 116*b* generally diverge outward and upward from the base 112 forming a half-diamond shape and maximizing the area of sail 118*b* available to catch the wind. Accordingly, the first and second sail frames 101*a* and 101*b* together provide two sails, each of which forms a half diamond shape, and together forms a diamond shaped sail area. In another embodiment, a connecting panel 126 can be attached between the first and second sails 118*a* and 118*b* forming a single sail area. In one embodiment, the connecting panel 126 can be temporarily attached to the two sails using snaps, hook and loop fasteners, or other suitable connectors. In another embodiment, the connecting panel 126 can be permanently attached to the first and second sails 118*a* and 118*b*.

Figure 2A:
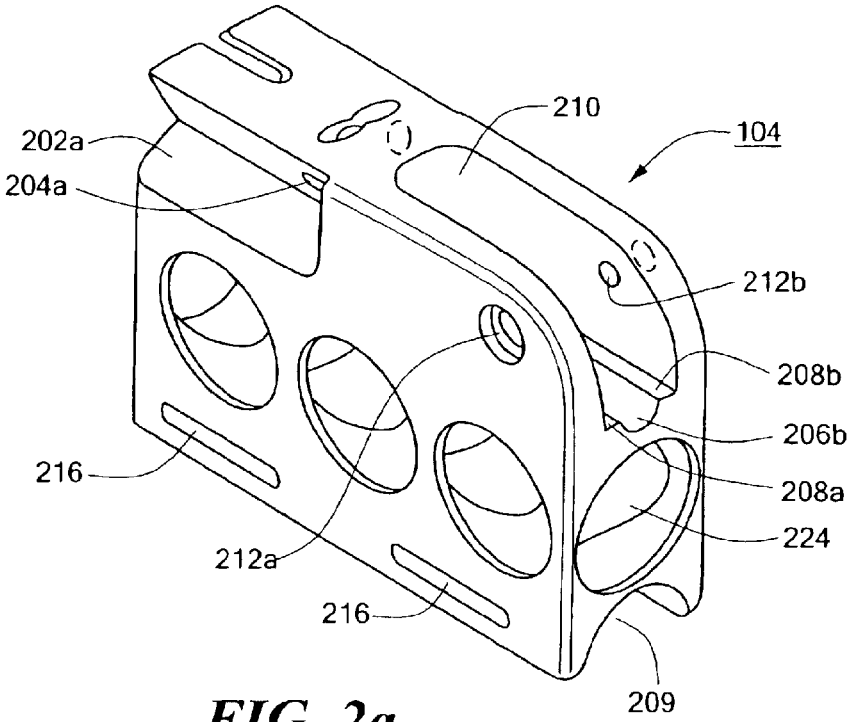
FIG. 2*a* is an isometric view of the base depicted in FIGS. 1*a* and 1*b;*
Figure 2B:
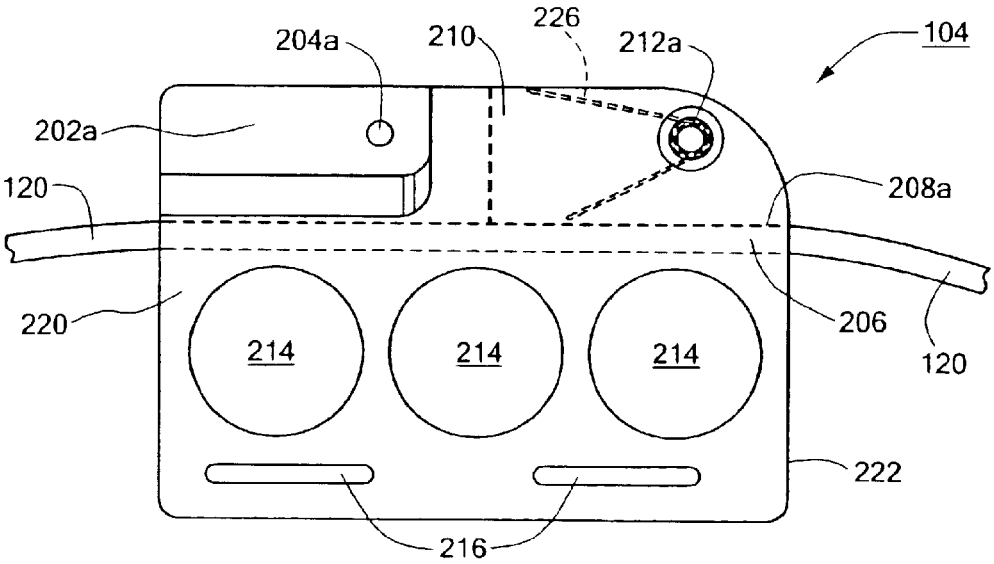
FIG. 2*b* is a side view of the base depicted in FIG. 2*a;*
Figure 2C:
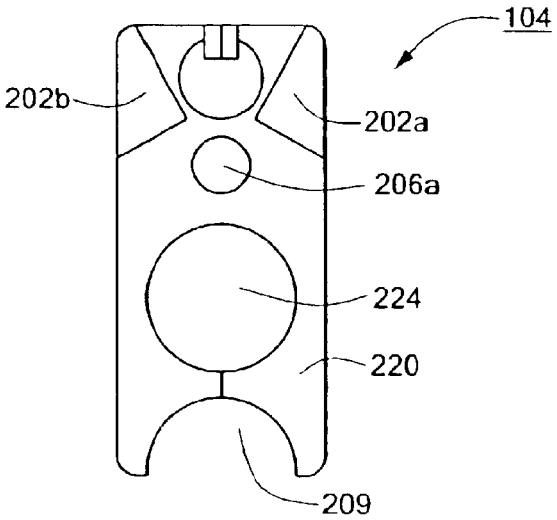
FIG. 2*c* is a front view of the base depicted in FIG. 2*a;*
Figure 2D:
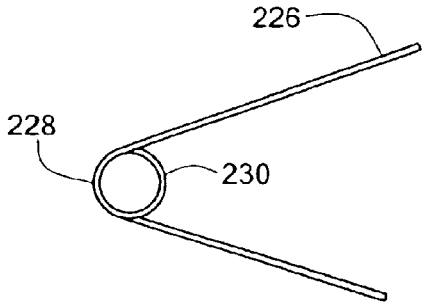
FIG. 2*d* is a side view of a biasing element suitable for use with the wind power device depicted in FIG. 1.

FIGS. 2A, 2B, and 2C (collectively, FIG. 2) depict the base 104. In the following description, it should be appreciated that the base 112 is identical to the base 104 and the discussions concerning base 104 are applicable to base 112, such that base 112 is not further discussed. In particular, the base 104 includes first and second portions 202*a* and 202*b*, respectively, that are sized and configured to receive the corresponding first and second boom arms. The first boom arm is attached via a first pivotal connection point 204*a* in section 202*a* and the second boom arm is attached via a second pivotal connection point (not shown) in section 202*b*. Accordingly, the first and second boom arms can be in the first closed position where they extend substantially parallel to one another and also to the longitudinal axis 107 of the base 104 or can be extended upward and outward to the second deployed position. In the second deployed position, the first and second boom arms extend upward and outward from the base 104 spreading the sail 118*a* between them as described above.

The base 104 includes a latch recess 210 that is sized and configured to receive the latch 106. As with the base, the latches 106 and 114 are identical and the description of latch 106 is applicable to latch 114, such that latch 114 will not be discussed further. The latch recess 210 includes a pair of pivotal connections 212*a* and 212*b* that are used to pivotally attach the latch 106 to the base 104. The latch recess 210 further includes a channel 206*b* that communicates with hole 206*a* and thereby provides a passageway extending through the base from the front surface 220 to the back surface 222. As will be explained in more detail below, the cord 120 is disposed within this passageway and thereby extends from the front surface 220 and the back surface 222. The channel 206*b* is formed between first and second torsion spring ledges 208*a* and 208*b*, respectively, that are sized and configured to receive first and second biasing elements. In one embodiment the biasing elements are a pair of generally "V" shaped torsion springs, of which one torsion spring 226 is shown. The torsion spring 226 is oriented such that the torsion spring is positioned on the corresponding torsion spring ledge such that the vertex 228 of the torsion spring 226 includes a mounting hole 230 that is aligned with the pivotal connections 212*a* and 212*b*, such that the vertex 228 of the torsion spring 226 is disposed proximate to the back surface 223 and the open end of the torsion springs is disposed proximate to the front surface 220. The orientation of the other torsion spring disposed on the other torsion spring ledge 208*b* is a mirror image of the torsion spring 226. The base 104 can also include a plurality of finger holes 214 to allow a user to grasp the base 104 when mounted on the shaft 102. In addition, slots 105 are provided to allow the temporary yet rigid attachment of the base to the shaft 102 as discussed above. Furthermore, a hole 224 can be provided to reduce the weight of the base 104 if desired.

Figure 3:
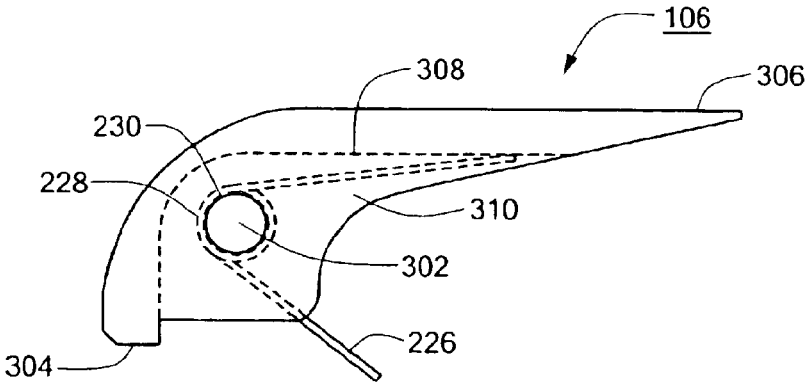
FIG. 3 is a side view of the latch and biasing element depicted in FIG. 1*a.*

FIG. 3 depicts the latch 106. It should be appreciated that the description of latch 106 is identical to latch 114, such that latch 114 will not be discussed further. Latch 106 includes a pivot connection hole 302, a holding ledge 304, a bias surface 308, a bias element channel 310, and a lever arm 306. In one embodiment, the biasing element, i.e., the torsion spring 226, is disposed within the bias element channel 310 such that the mounting hole 230 is aligned with the pivot connection hole 302. The latch 106 is disposed within the latch recess 210 of base 104 and is configured and oriented such that the pivot connection holes 212*a* and 212*b* are aligned with the pivot connection hole 302 and the mounting hole 230. The latch 106 and the torsion spring 226 are pivotally connected to the base via the aligned connection/pivot holes 212*a*, 212*b*, mounting hole 230 and pivot connection hole 302 using a suitable fastener.

As discussed above, the pair of biasing elements, which are torsion springs in the illustrated embodiment, are disposed beneath the latch 300 on the first and second torsion spring ledges 208*a* and 208*b*, respectively such that the torsion springs abut the corresponding torsion spring ledges and the bias surface 308 of the latch 106. The orientation of the torsion springs biases the lever arm 306 of latch 106 up and away from the base 104. This has the effect of forcing the holding ledge 304 down onto the channel 206 and the cord 120 disposed therein. The biasing elements provide sufficient force such that the holding ledge 306 is able to frictionally hold the cord 120 and prevent movement by the cord in one direction. Thus the latching mechanism is maintained in normally closed position in which movement of the cord 120 is prevented thus preventing the cord from being retracted, thus controlling the sail deployment.

By depressing the lever arm 306 of the latch 106, a user pivots the holding ledge 304 away from the channel 206 and the cord disposed therein, allowing the cord to slide freely within the channel 206 and to allow movement of the respective boom arms and thereby allow the deployment of the boom arms and the sail therebetween. Typically, the wind will be used to provide the necessary force to deploy the sail material and to move the first and second boom arms from the first retracted position to the second deployed position. Thus, the sail material connected between the booms arms extends and is able to catch the wind. The user then releases the lever arm 306 and the torsion springs will once again urge the latch 106 downward such that the holding ledge is again pressed against the cord disposed in channel 206 with sufficient force to prevent any further movement of the cord, thereby firmly holding the sails in place and preventing further deployment or retraction of the sail material. This procedure is repeated for both the first and second sail frames 101*a* and 101*b* to deploy both sails. The user is then free to hold the shaft securely and to orient the sails to provide the desired locomotive power. To retract the sail material, the user can pull the cord 120 disposed in the passageway formed by hole 206*a* and channel 206*b* in the direction opposite to the sail. This causes the latch to pivot toward the open position and automatically pulls the sail inward and the corresponding boom arms from the deployed position to the stored position.

Although a pair of sail frame assemblies are depicted on shaft 102, a single sail frame assembly can also be used. For example, a double bladed kayak paddle is considerably longer than a single blade canoe paddle, such that the kayak paddle can if desired support a pair of sail frame assemblies, while the shorter canoe paddle is typically long enough for only a single sail frame assembly. An ice skater, cross counter skier, or a skateboard or rollerblade user can select the length of shaft 102 that is desired and so select whether to utilize one or two sail frame assemblies. In addition, the sail frame assemblies can be sized for any shaft length and configuration.

Typically the shaft 102 can be constructed out of tubular aluminum, carbon fiber, or high strength plastic. The base 200, the latch 300, and the boom arms can be constructed from almost any material that is both strong, light weight, and non-corrosive. For example the various pieces can be constructed from aluminum that is molded or machined, or from high strength high impact resistant polymers that can be molded or machined. The sail is typically rip-stop nylon. The rope or cord is typically nylon rope or cord. The torsion springs are preferably constructed form a high strength non-corrosive material such as stainless steel.

It should be appreciated that other variations to and modifications of the above-described apparatus for a portable sail device may be made without departing from the inventive concepts described herein. Accordingly, the invention should not be viewed as limited except by the scope and spirit of the appended claims.

What is claimed is:

1. A wind power device for mounting a sail on a shaft comprising:

a base affixed to the shaft;

first and second boom arms coupled to the base, each having a stored position and a deployed position;

a latching mechanism comprising:

a latch pivotally attached to the base having a closed position and an open position, wherein while in the closed position the latch configured to maintain a cord attachable to the sail in a fixed position;

a biasing element configured to bias the latch into a closed position, the latch moveable against the biasing element into the open position wherein the cord is allowed to travel.

2. The wind power device of claim 1 further including:

a sail having first and second edges securely coupled to the first and second boom arms respectively, wherein when the first and second boom arms are in the deployed position the sail is opened and deployed therebetween and able to catch wind an wherein when the first and second boom arms when are in the stored position, the sail is closed and stored therebetween and unable to catch wind.

3. The wind power device of claim 1 wherein the first and second boom arms are pivotally coupled to opposite sides of the base and are outwardly and upwardly moveable.

4. The wind power device of claim 3 wherein the boom arms arc longitudinally extending elements with a plurality of holes therein for receiving a cord for mounting the sail.

5. The wind power device of claim 3 wherein when the first and second boom arms are in the stored position they extend along the longitudinal axis of the base and are substantially parallel to one another.

6. The wind power device of claim 3 wherein when the first and second boom arms in the deployed position, they extend upward and outward fro the base, forming substantially a half diamond shape.

7. The wind power device of claim 1 wherein the base further includes a sot to receive a strap fastener attachable around the shaft and secured using a fastener.

8. The wind power device of claim 7 wherein the fastener is a hook and loop fastener.

9. The wind power device of claim 1 wherein the base further includes a plurality of finger holes therein to allow the base and the shaft to be gripped together.

10. The wind power device of claim 1 wherein the biasing element includes first and second torsion springs.

11. The wind power device of claim 1 further including:

a second base affixed to the shaft;

third and fourth boom arms coupled to the base, each having a stored position and a deployed position;

a second latching mechanism comprising:

a second latch pivotally attached to the base having a closed position and an open position, the latch configured to maintain a cord attachable to the sail in a fixed position;

a second biasing element configured to bias the latch into a closed position, the latch moveable against the biasing element into the open position.

12. The wind power device of claim 11 further including:

a second sail having first and second edges securely coupled to the first and second boom arms respectively, wherein when the third and fourth boom arms are in the deployed position the second sail is opened and deployed therebetween and able to catch wind an wherein when the third and fourth boom arms when are in the stored position, the second sail is closed and stored therebetween and unable to catch wind.

13. The wind power device of claim 12 further including a connecting panel coupled to the first and second sail to form a single sail surface.

14. The wind power device of claim 11 wherein the third and fourth boom arms are pivotally coupled to opposite sides of the second base and are outwardly and upwardly moveable.

15. The wind power device of claim 14 wherein the third and fourth boom arms are longitudinally extending elements with a plurality of holes therein for receiving a cord for mounting the sail.

16. The wind power device of claim 14 wherein when the third and fourth boom arms are in the stored position they extend along the longitudinal axis of the second base and are substantially parallel to one another.

17. The wind power device of claim 14 wherein when the third and fourth boom arms in the deployed position, they extend upward and outward fro the base, forming substantially a half diamond shape.

18. The wind power device of claim 11 wherein the second base further includes a slot to receive a strap fastener attachable around the shaft and secured using a fastener.

19. The wind power device of claim 18 wherein the fastener is a hook and loop fastener.

20. The wind power device of claim 11 wherein the base further includes a plurality of finger holes therein to allow the base and the shaft to be gripped together.

21. The wind power device of claim 11 wherein the biasing element includes first and second torsion springs.

22. The wind power device of claim 1 wherein the shaft is a kayak or canoe paddle.

23. A wind power device for mounting a sail on a shaft comprising:

a base affixed to the shaft;

first and second boom arms coupled to the base, each having a stored position and a deployed position;

a latching mechanism comprising:

a latch pivotally attached to the base having a closed position and an open position, the latch configured to maintain a cord attachable to the sail in a fixed position;

a biasing element configured to bias the latch into a closed position, the latch moveable against the biasing element into the open position;

a sail having first and second edges securely coupled to the first and second boom arms respectively, wherein when the first and second boom arms are in the deployed position the sail is opened and deployed therebetween and able to catch wind and wherein when the first and second boom arms when are in the stored position, the sail is closed and stored therebetween and unable to catch wind;

a second base affixed to the shaft;

third and fourth boom arms coupled to the base, each having a stored position and a deployed position;

a second latching mechanism comprising:

a second latch pivotally attached to the base having a closed position and an open position, the latch configured to maintain a cord attachable to the sail in a fixed position;

a second biasing element configured to bias the latch into a closed position, the latch moveable against the biasing element into the open position a second sail having first and second edges securely coupled to the first and second boom arms respectively, wherein when the third and fourth boom arms are in the deployed position the second sail is opened and deployed therebetween and able to catch wind an wherein when the third and fourth boom arms when are in the stored position, the second sail is closed and stored therebetween and unable to catch wind.

24. The wind power device of claim 23 further including a connecting panel coupled to the first and second sail to form a single sail surface.

* * * * *